US008766022B2

(12) United States Patent
Clark et al.

(10) Patent No.: US 8,766,022 B2
(45) Date of Patent: Jul. 1, 2014

(54) METHOD FOR SYNERGISTICALLY INCREASING THE CETANE NUMBER OF A FUEL COMPOSITION AND A FUEL COMPOSITION COMPRISING A SYNERGISTICALLY INCREASED CETANE NUMBER

(75) Inventors: Richard Hugh Clark, Chester (GB); Richard James Stradling, Ince (GB); Robert Wilfred Matthews Wardle, Ince (GB)

(73) Assignee: Shell Oil Company, Houston, TX (US)

( * ) Notice: Subject to any disclaimer, the term of this patent is extended or adjusted under 35 U.S.C. 154(b) by 250 days.

(21) Appl. No.: 11/768,754

(22) Filed: Jun. 26, 2007

(65) Prior Publication Data

US 2008/0033220 A1 Feb. 7, 2008

(30) Foreign Application Priority Data

Jun. 28, 2006 (EP) ..... 06253376

(51) Int. Cl.
*C10L 1/18* (2006.01)
*C10L 1/19* (2006.01)
*C10L 1/188* (2006.01)

(52) U.S. Cl.
USPC ..... 585/14; 44/436; 44/437; 44/443; 44/444; 585/1; 585/3; 123/1 A

(58) Field of Classification Search
USPC ..... 585/14, 1, 13; 123/1 A; 44/436, 437, 44/443, 444
See application file for complete search history.

(56) References Cited

U.S. PATENT DOCUMENTS

| | | | | |
|---|---|---|---|---|
| 4,448,587 | A * | 5/1984 | Hinkamp et al. | 44/324 |
| 2004/0144690 | A1 * | 7/2004 | Lloyd et al. | 208/15 |
| 2005/0256352 | A1 * | 11/2005 | Clark et al. | 585/14 |
| 2005/0262759 | A1 * | 12/2005 | Tort et al. | 44/301 |
| 2006/0049080 | A1 * | 3/2006 | Bacha et al. | 208/15 |

FOREIGN PATENT DOCUMENTS

WO WO 9714769 A1 * 4/1997

OTHER PUBLICATIONS

A. Thompson et al. "Prediction and Precision of Cetane Number Improver Response Equations," SAE Special Publications; Gasoline and Diesel Fuel Performance and Additives, vol. 1302, Oct. 1997, pp. 193-198, XP008072689.

* cited by examiner

*Primary Examiner* — Pamela H Weiss

(57) ABSTRACT

A method for increasing the cetane number of a fuel composition containing a Fischer-Tropsch derived fuel component, in order to reach a target cetane number X, is provided by adding to the composition a concentration c of an ignition improver, wherein c is lower than the concentration which theory would predict needed to be added in order to achieve the target. The ignition improver is preferably 2-ethylhexyl nitrate and the fuel composition suitably a diesel or kerosene fuel. A fuel composition for use in a compression ignition engine, which has a cetane number of 85 or greater, and contains a Fischer-Tropsch derived fuel component and an ignition improver is also disclosed.

4 Claims, No Drawings

METHOD FOR SYNERGISTICALLY INCREASING THE CETANE NUMBER OF A FUEL COMPOSITION AND A FUEL COMPOSITION COMPRISING A SYNERGISTICALLY INCREASED CETANE NUMBER

FIELD OF THE INVENTION

The present invention relates to the use of certain types of fuel components and additives in fuel compositions. The invention also provides a method for increasing the cetane number of a fuel composition, in particular a diesel fuel composition.

BACKGROUND OF THE INVENTION

The cetane number of a fuel composition is a measure of its ease of ignition and combustion. With a lower cetane number fuel a compression ignition (diesel) engine tends to be more difficult to start and may run more noisily when cold; conversely a fuel of higher cetane number tends to impart easier cold starting, to alleviate white smoke ("cold smoke") caused by incomplete combustion after starting and to have a positive impact on emissions such as NOx and particulate matter during engine operation.

SUMMARY OF THE INVENTION

A method for increasing the cetane number of a fuel composition is provided which contains a Fischer-Tropsch derived fuel component, in order to reach a target cetane number X, comprising adding to the composition a concentration c of an ignition improver, wherein c is lower than the concentration c' of the ignition improver which theory would predict needed to be added to the composition in order to achieve cetane number X.

A fuel composition for use in a compression ignition engine, which has a cetane number of 85 or greater, and contains a Fischer-Tropsch derived fuel component and an ignition improver is also provided.

DETAILED DESCRIPTION OF THE INVENTION

There is a general preference for a diesel fuel composition to have a high cetane number, a preference which has become stronger as emissions legislation grows increasingly stringent, and as such automotive diesel specifications generally stipulate a minimum cetane number. Many diesel fuel compositions contain ignition improvers, also known as cetane boost additives or cetane (number) improvers, to ensure compliance with such specifications and generally to improve the combustion characteristics of the fuels.

One of the most commonly used diesel fuel ignition improvers is 2-ethylhexyl nitrate (2-EHN), which operates by shortening the ignition delay of a fuel to which it is added. However, 2-EHN is also a radical initiator, and can potentially have an adverse effect on the thermal stability of a fuel. Poor thermal stability in turn results in an increase in the products of instability reactions, such as gums, lacquers and other insoluble species. These products can block engine filters and foul fuel injectors and valves, and consequently can result in loss of engine efficiency or emissions control.

There are also health and safety concerns regarding the use of 2-EHN, which is a strong oxidising agent and is also readily combustible in its pure form. It can also be difficult to store in concentrated form, as it tends to degrade to form peroxides, themselves prone to forming potentially explosive mixtures.

These disadvantages, taken together with the often significant cost of incorporating 2-EHN as an additive into a fuel composition, mean that it would be generally desirable to reduce 2-EHN levels in diesel fuel compositions, whilst at the same time maintaining acceptable combustion properties.

The reaction products of Fischer-Tropsch condensation processes for example the process known as Shell Middle Distillate Synthesis (van der Burgt et al, "The Shell Middle Distillate Synthesis Process", paper delivered at the 5th Synfuels Worldwide Symposium, Washington D.C., November 1985; see also the November 1989 publication of the same title from Shell International Petroleum Company Ltd, London, UK) can be included in fuel compositions. In particular, Fischer-Tropsch derived gas oils can be included in automotive diesel fuel compositions.

Fischer-Tropsch derived fuel components, also known as GTL ("Gas-To-Liquid") fuels, tend to have higher cetane numbers than for instance petroleum derived diesel fuels. Following conventional fuel formulation principles, it can therefore be expected that the addition of a Fischer-Tropsch derived fuel component to a base fuel having a lower cetane number will increase the cetane number of the resultant blend to an extent directly proportional to the amount of the Fischer-Tropsch fuel added.

It is also possible to predict the effect of an ignition improver on the cetane number of a fuel composition to which it is added. For the common ignition improver 2-EHN, for example, the cetane number of such a composition can be calculated using equation (I) below:

$$\Delta CN=0.16\times(CN_b)^{0.36}\times(G)^{0.57}\times(C)^{0.032}\times\mathrm{Ln}(1+17.5C) \quad \text{(I)}$$

where $CN_b$ is the "base" cetane number, i.e. the cetane number of the fuel composition without the ignition improver; G is the API Gravity of that fuel composition; and ΔCN is the increase in cetane number due to incorporation of the ignition improver at a concentration C (% v/v) (see Thompson et al, "Prediction and Precision of Cetane Number Improver Response Equations", SAE International Fall Fuels & Lubricants Meeting & Exposition, Tulsa, Okla., October 1997, SAE Technical Paper Series No. 972901). It is generally preferred to use such an equation to predict the theoretical cetane number of a fuel composition, although other equations, for instance based on the distillation properties of a fuel rather than its base cetane number (see Equation 1 in the SAE paper listed above), may be used in some cases.

Equations for other ignition improvers, or mixtures of ignition improvers, can be derived using methodology analogous to that in the SAE paper, for instance from cetane number measurements for a range of crude oil derived middle distillate (in particular diesel, and more particularly non-Fischer-Tropsch derived) fuels blended with a range of concentrations of the relevant ignition improver. Such equations, which again preferably rely on the base cetane number of the fuel rather than on its distillation properties, are likely to be similar to equation (I) but with an appropriate response factor included as a multiplier—for example, the SAE paper refers to the use of equation (I) for the ignition improver di-tert-butyl peroxide, using a response factor of 0.74. References below to equation (I) may be taken to mean a version of equation (I) appropriate for the ignition improver(s) used in the case in question.

It has been discovered, however, that when a fuel composition contains a Fischer-Tropsch derived fuel component, the effect of an added ignition improver, on the cetane number of the composition, can deviate to a statistically significant extent from theoretical equations such as equation (I). Indeed the cetane number of the composition appears to be significantly higher, at any given concentration of ignition improver, than an equation such as (I)—which would be expected to hold for most middle distillate fuels, in particular non-Fischer Tropsch derived fuels and most particularly petroleum derived fuels—would predict. This apparent synergy, between the Fischer-Tropsch derived fuel and the ignition improver, thus provides a "boost" in the cetane number of the overall composition, above that which theory would predict to be possible and greater than that which would have been expected from the effects of the two components individually.

Based on this discovery, the present invention is able to provide more optimised methods for formulating fuel compositions, in particular to achieve target cetane numbers.

According to a first aspect of the present invention there is provided a method for increasing the cetane number of a fuel composition which contains a Fischer-Tropsch derived fuel component, in order to reach a target cetane number X, which method comprises adding to the composition a concentration c of an ignition improver, wherein c is lower than the concentration c' of the ignition improver which theory would predict needed to be added to the composition in order to achieve cetane number X.

The theoretical ignition improver concentration, c', is suitably calculated using equation (I) above, i.e. $\Delta CN=0.16\times(CN_b)^{0.36}\times(G)^{0.57}\times(c')^{0.032}\times Ln(1+17.5c')$ where $CN_b$ is the cetane number of the fuel composition without the ignition improver; G is the API Gravity of that fuel composition; and $\Delta CN$ is the increase in cetane number due to incorporation of the ignition improver at concentration c'. In this case, the cetane number $CN_b$ may be taken to be that of the fuel composition containing the Fischer-Tropsch derived component prior to addition of the ignition improver. Such a composition may optionally contain one or more non-Fischer-Tropsch derived fuel components.

A second aspect of the present invention provides the use of a Fischer-Tropsch derived fuel component, in a fuel composition containing an ignition improver, for the dual purposes of:

a) achieving a target cetane number X for the composition; and
b) reducing the concentration of the ignition improver to a level below the concentration c' which theory would predict needed to be included in the composition in order to achieve cetane number X.

Conversely, according to the present invention a Fischer-Tropsch derived fuel component may be used to increase the cetane number of a fuel composition containing an ignition improver, the Fischer-Tropsch fuel itself being used at a lower concentration than theory would predict needed to be used in order to achieve a desired target cetane number.

Thus, according to a third aspect the present invention provides a method for increasing the cetane number of a fuel composition which contains an ignition improver, in order to reach a target cetane number X, which method comprises adding to the composition a concentration d of a Fischer-Tropsch derived fuel component having a cetane number greater than the cetane number of the fuel composition without the ignition improver, wherein d is lower than the concentration d' of the Fischer-Tropsch component which theory would predict needed to be added to the composition in order to achieve cetane number X.

The theoretical Fischer-Tropsch fuel concentration d' may be calculated as follows. Firstly, equation (I) above may be used to calculate the theoretical base cetane number $CN_b'$ of a fuel composition which would be needed, on addition of the ignition improver at concentration I, in order to give the target cetane number X. Secondly, the concentration d' of the Fischer-Tropsch derived fuel component, which ought to be needed in order for a composition to have a cetane number $CN_b'$, can be calculated using standard linear blending rules. For instance, if a fuel composition contains a concentration x % v/v of a non-Fischer-Tropsch derived fuel component having a cetane number A, and (100−x) % v/v of a Fischer-Tropsch derived component having a higher cetane number B, then the overall cetane number CN of the blend may be calculated using equation (II) below:

$$CN=A+x(B-A)/100 \quad \text{(II)}$$

A fourth aspect of the present invention provides the use of a Fischer-Tropsch derived fuel component, at a concentration d, in a fuel composition containing an ignition improver, for the purpose of increasing the cetane number of the composition by a greater amount than that which theory would predict to be possible using the Fischer-Tropsch derived fuel component at concentration d.

If equation (I) applied as expected to fuel compositions containing both a Fischer-Tropsch derived fuel component and an ignition improver, it would then be straightforward to calculate the amount of ignition improver and/or Fischer-Tropsch derived fuel needed to increase the cetane number of a composition to reach a target cetane number. However it has now been found that a Fischer-Tropsch derived fuel component can "boost" the cetane number of a fuel composition containing an ignition improver, above the level that would be expected if equation (I) applied. This allows a lower amount of the ignition improver to be used to achieve any given target cetane number X, in turn reducing the costs and other drawbacks associated with the use of such additives, as discussed above.

Conversely, in accordance with the third aspect of the present invention, a lower amount of the Fischer-Tropsch derived fuel component can be used, at any given concentration of the ignition improver, in order to achieve a target cetane number X, thus lowering any costs or other detrimental effects associated with inclusion of the Fischer-Tropsch fuel, for example reduction in density and consequent increase in fuel consumption.

According to a fifth aspect of the present invention, an ignition improver may therefore be used, in a fuel composition containing a Fischer-Tropsch derived fuel component, for the dual purposes of:

a) achieving a target cetane number X for the composition; and
b) reducing the concentration of the Fischer-Tropsch derived fuel component to a level below the concentration d' which theory would predict needed to be included in the composition in order to achieve cetane number X.

A certain minimum cetane number may be desirable in order for a fuel composition to meet current fuel specifications, and/or to comply with local regulations, and/or to satisfy consumer demand. According to the present invention, such standards may still be achievable even with reduced levels of ignition improver, due to the presence of the Fischer-Tropsch derived fuel component.

Since it may be desirable to include a Fischer-Tropsch derived component in a fuel composition for other reasons, for example to reduce emissions from a fuel-consuming system (typically an engine) running on the fuel composition, and/or to reduce the level of sulphur, aromatics or other polar components in the composition, the ability to use a Fischer-Tropsch component for the additional purpose of boosting the cetane number of the composition, and/or reducing its ignition improver concentration, can provide significant formulation advantages. Generally speaking the present invention can provide greater flexibility in fuel formulation, allowing a target cetane number to be achieved more readily by altering the concentration of the Fischer-Tropsch fuel and/or the ignition improver.

In the context of the present invention, "use" of a Fischer-Tropsch derived fuel component or an ignition improver in a fuel composition means incorporating the component into the composition, typically as a blend (i.e. a physical mixture) with one or more other fuel components. The Fischer-Tropsch derived component or ignition improver will conveniently be incorporated before the composition is introduced into an engine or other system which is to be run on the composition. Instead or in addition the use of a Fischer-Tropsch derived fuel component or ignition improver may involve running a fuel-consuming system, typically a diesel engine, on a fuel composition containing the relevant component, typically by introducing the composition into a combustion chamber of an engine.

"Use" of a Fischer-Tropsch derived fuel component or ignition improver in the ways described above may also embrace supplying such a component together with instructions for its use in a fuel composition to achieve the purpose(s) of any of the first to the fifth aspects of the present invention, for instance to achieve a desired target cetane number and/or to reduce the concentration of ignition improver in the composition. The Fischer-Tropsch derived fuel component or ignition improver may be supplied as part of a formulation which is suitable for and/or intended for use as a fuel additive.

In particular, in accordance with a sixth aspect of the present invention, there is provided the use of a Fischer-Tropsch derived fuel component and an ignition improver together, for one or more of the purposes described above in connection with the first to the fifth aspects of the present invention, for instance to achieve a target cetane number X in a fuel composition to which the two components are added. The Fischer-Tropsch derived fuel and the ignition improver may for instance be supplied, and/or added to a fuel composition, in the form of a fuel additive package containing both components, optionally with other fuel additives.

In general, references to "adding" or "incorporating" a component to a fuel composition may be taken to embrace addition or incorporation at any point during the carrying out of a method according to the present invention. Thus, in accordance with the present invention, a fuel composition may be mixed with an ignition improver and subsequently with a Fischer-Tropsch derived fuel component, or alternatively such a composition may be mixed with a Fischer-Tropsch derived fuel component prior to addition of an ignition improver. The cetane number of the relevant binary mixture may be measured prior to adding the third component in order to reach the target value.

In accordance with the present invention, the cetane number of a fuel composition may be determined in known manner, for instance using the standard test procedure ASTM D613 (ISO 5165, IP 41) which provides a so-called "measured" cetane number obtained under engine running conditions.

More preferably the cetane number may be determined using the more recent and accurate "ignition quality test" (IQT) (ASTM D6890, IP 498), which provides a "derived" cetane number based on the time delay between injection and combustion of a fuel sample introduced into a constant volume combustion chamber. This relatively rapid technique can be used on laboratory scale (ca 100 ml) samples of a range of different fuels.

Alternatively, cetane number may be measured by near infrared spectroscopy (NIR), as for example described in U.S. Pat. No. 5,349,188. This method may be preferred in a refinery environment as it can be less cumbersome than for instance ASTM D613. NIR measurements make use of a correlation between the measured spectrum and the actual cetane number of a sample. An underlying model is prepared by correlating the known cetane numbers of a variety of fuel samples with their near infrared spectral data.

The present invention preferably results in a fuel composition which has a derived cetane number (IP 498) of 55 or greater, more preferably of 60 or 65 or 70 or greater, most preferably of 75 or greater. These may therefore be suitable values for the target cetane number X.

"Reaching" a target cetane number can also embrace exceeding that number. Thus, the target cetane number X may be a target minimum cetane number.

The present invention may be used to achieve a desired target boost (increase), $\Delta X$, in the cetane number of the fuel composition, where $\Delta X$ is greater than the boost in cetane number which theory (for example, equation (I) above) would predict to result based on the concentrations of the Fischer-Tropsch derived fuel component and the ignition improver used in the composition. In this context, $\Delta X$ is preferably at least 70% greater than the cetane number boost predicted by theory, more preferably at least 80 or 100%, most preferably at least 125 or 140 or 150 or even 200%. In absolute terms, $\Delta X$ is preferably 3 or 6 or 8 or 10 or more, ideally 15 or 20 or 25 or even 30 or more. Such $\Delta X$ values may for instance be determined at an ignition improver concentration of up to 0.3% v/v, preferably up to 0.1% v/v, more preferably up to 0.05% v/v.

The cetane number boost is preferably achieved using a lower concentration of the Fischer-Tropsch derived fuel component and/or the ignition improver than theory would predict to be necessary.

The present invention may additionally or alternatively be used to adjust any property of the fuel composition which is equivalent to or associated with cetane number, for example to improve the combustion performance of the fuel composition (e.g. to shorten ignition delays, to facilitate cold starting or to reduce incomplete combustion and/or associated emissions in a fuel-consuming system running on the fuel composition) and/or to improve fuel economy or exhaust emissions generally.

The cetane number of a fuel composition which results from carrying out the present invention may be 5% or more higher than the value which theory would predict to result from adding the same concentrations of the ignition improver and the Fischer-Tropsch derived fuel component. It may be at least 8, 10, 15, 20 or even 25% higher than the theoretical value. In absolute terms, the cetane number of the composition may be at least 5 or 10 or 15 or even 20 higher than the theoretically predicted value.

The fuel composition to which the present invention is applied may, prior to incorporation of the ignition improver and the Fischer-Tropsch derived fuel component, have a relatively low cetane number, for instance 55 or less, in cases 50 or 48 or 45 or even 40 or less.

A fuel composition to which the present invention has been applied may contain any proportion of the Fischer-Tropsch derived fuel component. Typically it will contain a major proportion (by which is meant typically 80% v/v or greater, more suitably 90 or 95% v/v or greater, most preferably 98 or 99 or 99.5% v/v or greater) of, or consist essentially or entirely of, a base fuel such as a distillate hydrocarbon base fuel, together with the ignition improver and optionally with one or more additional components such as fuel additives. In this case the base fuel may contain up to 100% of the Fischer-Tropsch derived fuel component, preferably up to 90 or 75 or 50% v/v, more preferably up to 40 or 30% v/v. The concentration of the Fischer-Tropsch derived fuel component in the base fuel is preferably 1% v/v or greater, more preferably 5% v/v or greater, yet more preferably 10 or 15% v/v or greater, most preferably 20 or 25 or 30 or 40 or 50% v/v or greater. Such a base fuel may also contain one or more non-Fischer-Tropsch derived (for example petroleum derived) fuel components.

A base fuel may for example be a naphtha, kerosene or diesel fuel, preferably a kerosene or diesel fuel, more preferably a diesel fuel.

Thus the fuel composition used in the present invention may be for example a naphtha, kerosene or diesel fuel composition, preferably kerosene or diesel, more preferably diesel. It may in particular be a middle distillate fuel composition, for example a heating oil, an industrial gas oil, an on- or off-road automotive diesel fuel, a railroad diesel fuel, a distillate marine fuel, a diesel fuel for use in mining applications or a kerosene fuel such as an aviation fuel or heating kerosene. Preferably the fuel composition is for use in an engine such as an automotive engine or an aircraft engine. More preferably it is for use in an internal combustion engine; yet more preferably it is an automotive fuel composition, still more preferably a diesel fuel composition which is suitable for use in a compression ignition engine. The present invention may generally be of use for any fuel composition intended for, and/or adapted for, use in a compression ignition engine.

A naphtha base fuel will typically boil in the range from 25 to 175° C. A kerosene base fuel will typically boil in the range from 150 to 275° C. A diesel base fuel will typically boil in the range from 150 to 400° C.

The base fuel may in particular be a middle distillate base fuel, in particular a diesel base fuel, and in this case it may itself comprise a mixture of middle distillate fuel components (components typically produced by distillation or vacuum distillation of crude oil), or of fuel components which together form a middle distillate blend. Middle distillate fuel components or blends will typically have boiling points within the usual middle distillate range of 125 to 550° C. or 150 to 400° C.

A diesel base fuel may be an automotive gas oil (AGO). Typical diesel fuel components comprise liquid hydrocarbon middle distillate fuel oils, for instance petroleum derived gas oils. Such base fuel components may be organically or synthetically derived. They will typically have boiling points within the usual diesel range of 125 or 150 to 400 or 550° C., depending on grade and use. They will typically have densities from 0.75 to 1.0 g/cm$^3$, preferably from 0.8 to 0.9 or 0.86 g/cm$^3$, at 15° C. (IP 365) and measured cetane numbers (ASTM D613) of from 35 to 80, more preferably from 40 to 75 or 70. Their initial boiling points will suitably be in the range 150 to 230° C. and their final boiling points in the range 290 to 400° C. Their kinematic viscosity at 40° C. (ASTM D445) might suitably be from 1.5 to 4.5 mm$^2$/s.

Such fuels are generally suitable for use in compression ignition (diesel) internal combustion engines, of either the indirect or direct injection type.

An automotive diesel fuel composition which results from carrying out the present invention will also preferably fall within these general specifications. Suitably it will comply with applicable current standard specification(s) such as for example EN 590 (for Europe) or ASTM D975 (for the USA). By way of example, the fuel composition may have a density from 0.82 to 0.845 g/cm$^3$ at 15° C.; a $T_{95}$ boiling point (ASTM D86) of 360° C. or less; a cetane number (ASTM D613) of 51 or greater; a kinematic viscosity (ASTM D445) from 2 to 4.5 mm$^2$/s at 40° C.; a sulphur content (ASTM D2622) of 50 mg/kg or less; and/or a polycyclic aromatic hydrocarbons (PAH) content (IP 391 (mod)) of less than 11% w/w. Relevant specifications may, however, differ from country to country and from year to year and may depend on the intended use of the fuel composition.

A petroleum derived gas oil may be obtained from refining and optionally (hydro) processing a crude petroleum source. It may be a single gas oil stream obtained from such a refinery process or a blend of several gas oil fractions obtained in the refinery process via different processing routes. Examples of such gas oil fractions are straight run gas oil, vacuum gas oil, gas oil as obtained in a thermal cracking process, light and heavy cycle oils as obtained in a fluid catalytic cracking unit and gas oil as obtained from a hydrocracker unit. Optionally a petroleum derived gas oil may comprise some petroleum derived kerosene fraction.

Such gas oils may be processed in a hydrodesulphurisation (HDS) unit so as to reduce their sulphur content to a level suitable for inclusion in an automotive fuel composition. This also tends to reduce the content of other polar species such as oxygen- or nitrogen-containing species.

In the methods of the present invention, a base fuel may be or contain a so-called "biofuel" component such as a vegetable oil or vegetable oil derivative (e.g. a fatty acid ester, in particular a fatty acid methyl ester) or another oxygenate such as an acid, ketone or ester. Such components need not necessarily be bio-derived.

The base fuel preferably has a low sulphur content, for example at most 1000 mg/kg. More preferably it will have a low or ultra low sulphur content, for instance at most 500 mg/kg, preferably no more than 350 mg/kg, most preferably no more than 100 or 50 or 10 or even 5 mg/kg, of sulphur. It may be a so-called "zero-sulphur" fuel. Ideally a fuel composition which results from carrying out the present invention will also have a sulphur content falling within these limits.

The Fischer-Tropsch derived fuel component used in the present invention may be for example a Fischer-Tropsch derived naphtha, kerosene or gas oil, preferably a kerosene or gas oil, more preferably a gas oil.

By "Fischer-Tropsch derived" is meant that a fuel is, or derives from, a synthesis product of a Fischer-Tropsch condensation process. A Fischer-Tropsch derived fuel may also be referred to as a GTL (Gas-to-Liquid) fuel. The term "non-Fischer-Tropsch derived" may be construed accordingly.

Fischer-Tropsch derived fuels are known and in use in for instance automotive diesel fuel compositions, and are described in more detail below. They tend to be low in undesirable fuel components such as sulphur, nitrogen and aromatics and also have lower densities than their petroleum derived counterparts. As a result, they can be blended with conventional petroleum derived diesel fuels to reduce vehicle emissions, in particular particulates and black smoke, levels of such emissions being closely linked with fuel density.

The Fischer-Tropsch reaction converts carbon monoxide and hydrogen into longer chain, usually paraffinic, hydrocarbons:

$$n(CO+2H_2)=(—CH_2—)_n+nH_2O+\text{heat},$$

in the presence of an appropriate catalyst and typically at elevated temperatures (e.g. 125 to 300° C., preferably 175 to 250° C.) and/or pressures (e.g. 5 to 100 bar, preferably 12 to 50 bar). Hydrogen:carbon monoxide ratios other than 2:1 may be employed if desired.

The carbon monoxide and hydrogen may themselves be derived from organic or inorganic, natural or synthetic sources, typically either from natural gas or from organically derived methane. The gases which are converted into liquid fuel components using such processes can in general include natural gas (methane), LPG (e.g. propane or butane), "condensates" such as ethane, synthesis gas (CO/hydrogen) and gaseous products derived from coal, biomass and other hydrocarbons.

Gas oil, naphtha and kerosene products may be obtained directly from the Fischer-Tropsch reaction, or indirectly for instance by fractionation of Fischer-Tropsch synthesis products or from hydrotreated Fischer-Tropsch synthesis products. Hydrotreatment can involve hydrocracking to adjust the boiling range (see, e.g. GB-B-2077289 and EP-A-0147873) and/or hydroisomerisation which can improve cold flow properties by increasing the proportion of branched paraffins. EP-A-0583836 describes a two step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired gas oil fraction(s) may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. Nos. 4,125,566 and 4,478,955.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0583836 (pages 3 and 4).

An example of a Fischer-Tropsch based process is the SMDS (Shell Middle Distillate Synthesis) described by van der Burgt et al in "The Shell Middle Distillate Synthesis Process", supra. This process (also sometimes referred to as the Shell "Gas-To-Liquids" or "GTL" technology) produces middle distillate range products by conversion of a natural gas (primarily methane) derived synthesis gas into a heavy long chain hydrocarbon (paraffin) wax which can then be hydroconverted and fractionated to produce liquid transport fuels such as the gas oils useable in automotive diesel fuel compositions. A version of the SMDS process, utilising a fixed bed reactor for the catalytic conversion step, is currently in use in Bintulu, Malaysia and its gas oil products have been blended with petroleum derived gas oils in commercially available automotive fuels.

Gas oils, naphthas and kerosenes prepared by the SMDS process are commercially available for instance from Shell companies. Further examples of Fischer-Tropsch derived gas oils are described in EP-A-0583836, EP-A-1101813, WO-A-97/14768, WO-A-97/14769, WO-A-00/20534, WO-A-00/20535, WO-A-00/11116, WO-A-00/11117, WO-A-01/83406, WO-A-01/83641, WO-A-01/83647, WO-A-01/83648 and U.S. Pat. No. 6,204,426.

By virtue of the Fischer-Tropsch process, a Fischer-Tropsch derived fuel has essentially no, or undetectable levels of, sulphur and nitrogen. Compounds containing these heteroatoms tend to act as poisons for Fischer-Tropsch catalysts and are therefore removed from the synthesis gas feed. Further, the Fischer-Tropsch process as usually operated produces no or virtually no aromatic components: the aromatics content of a Fischer-Tropsch derived fuel, suitably determined by ASTM D4629, will typically be below 1% w/w, preferably below 0.5% w/w and more preferably below 0.1% w/w.

Generally speaking, Fischer-Tropsch derived fuels have relatively low levels of polar components, in particular polar surfactants, for instance compared to petroleum derived fuels. Such polar components may include for example oxygenates, and sulphur- and nitrogen-containing compounds. A low level of sulphur in a Fischer-Tropsch derived fuel is generally indicative of low levels of both oxygenates and nitrogen-containing compounds, since all are removed by the same treatment processes.

Where a Fischer-Tropsch derived fuel component is a naphtha fuel, it will be a liquid hydrocarbon distillate fuel with a final boiling point of typically up to 220° C. or preferably of 180° C. or less. Its initial boiling point is preferably higher than 25° C., more preferably higher than 35° C. Its components (or the majority, for instance 95% w/w or greater, thereof) are typically hydrocarbons having 5 or more carbon atoms; they are usually paraffinic.

In the context of the present invention, a Fischer-Tropsch derived naphtha fuel preferably has a density of from 0.67 to 0.73 g/cm$^3$ at 15° C. and/or a sulphur content of 5 mg/kg or less, preferably 2 mg/kg or less. It preferably contains 95% w/w or greater of iso- and normal paraffins, preferably from 20 to 98% w/w or greater of normal paraffins. It is preferably the product of a SMDS process, preferred features of which may be as described below in connection with Fischer-Tropsch derived gas oils.

A Fischer-Tropsch derived kerosene fuel is a liquid hydrocarbon middle distillate fuel with a distillation range suitably from 140 to 260° C., preferably from 145 to 255° C., more preferably from 150 to 250° C. or from 150 to 210° C. It will have a final boiling point of typically from 190 to 260° C., for instance from 190 to 210° C. for a typical "narrow-cut" kerosene fraction or from 240 to 260° C. for a typical "full-cut" fraction. Its initial boiling point is preferably from 140 to 160° C., more preferably from 145 to 160° C.

A Fischer-Tropsch derived kerosene fuel preferably has a density of from 0.730 to 0.760 g/cm$^3$ at 15° C.—for instance from 0.730 to 0.745 g/cm$^3$ for a narrow-cut fraction and from 0.735 to 0.760 g/cm$^3$ for a full-cut fraction. It preferably has a sulphur content of 5 mg/kg or less. It may have a cetane number of from 63 to 75, for example from 65 to 69 for a narrow-cut fraction or from 68 to 73 for a full-cut fraction. It is preferably the product of a SMDS process, preferred features of which may be as described below in connection with Fischer-Tropsch derived gas oils.

A Fischer-Tropsch derived gas oil should be suitable for use as a diesel fuel, ideally as an automotive diesel fuel; its components (or the majority, for instance 95% w/w or greater, thereof) should therefore have boiling points within the typical diesel fuel ("gas oil") range, i.e. from 150 to 400° C. or from 170 to 370° C. It will suitably have a 90% w/w distillation temperature of from 300 to 370° C.

A Fischer-Tropsch derived gas oil will typically have a density from 0.76 to 0.79 g/cm$^3$ at 15° C.; a cetane number (ASTM D613) greater than 70, suitably from 74 to 85; a kinematic viscosity (ASTM D445) from 2 to 4.5, preferably from 2.5 to 4.0, more preferably from 2.9 to 3.7, mm$^2$/s at 40° C.; and a sulphur content (ASTM D2622) of 5 mg/kg or less, preferably 2 mg/kg or less.

Preferably a Fischer-Tropsch derived fuel component used in the present invention is a product prepared by a Fischer-Tropsch methane condensation reaction using a hydrogen/carbon monoxide ratio of less than 2.5, preferably less than 1.75, more preferably from 0.4 to 1.5, and ideally using a cobalt containing catalyst. Suitably it will have been obtained from a hydrocracked Fischer-Tropsch synthesis product (for instance as described in GB-B-2077289 and/or EP-A-0147873), or more preferably a product from a two-stage hydroconversion process such as that described in EP-A-0583836 (see above). In the latter case, preferred features of the hydroconversion process may be as disclosed at pages 4 to 6, and in the examples, of EP-A-0583836.

Suitably, in accordance with the present invention, a Fischer-Tropsch derived fuel component will consist of at least 70% w/w, preferably at least 80% w/w, more preferably at least 90% w/w, most preferably at least 95 or 98 or even 99% w/w, of paraffinic components, preferably iso- and normal paraffins. The weight ratio of iso-paraffins to normal paraffins will suitably be greater than 0.3 and may be up to 12; suitably it is from 2 to 6. The actual value for this ratio will be determined, in part, by the hydroconversion process used to prepare the fuel from the Fischer-Tropsch synthesis product.

The olefin content of the Fischer-Tropsch derived fuel component is suitably 0.5% w/w or lower. Its aromatics content is suitably 0.5% w/w or lower.

According to the present invention, a mixture of two or more Fischer-Tropsch derived fuel components may be used in the fuel composition.

The Fischer-Tropsch derived fuel component may be added to the fuel composition for one or more other purposes in addition to the desire to increase cetane number and/or reduce the ignition improver concentration, for instance to reduce emissions (regulated and/or carbon dioxide) from a fuel-consuming system running on the fuel composition, or to reduce the level of sulphur and/or aromatics and/or other polar components in the composition. Thus the present invention can be used to optimise the properties and performance of a fuel composition in a number of ways, and can therefore provide additional flexibility in fuel formulation.

The concentration of the Fischer-Tropsch derived component in the fuel composition, after carrying out the present invention, will preferably be 1% v/v or greater, more preferably 5% v/v or greater, yet more preferably 10 or 15 or 20% v/v or greater. Its concentration may be up to 99.99% v/v, such as up to 99.8 or 99.5 or 99 or 98% v/v, preferably up to 75 or 50% v/v, more preferably up to 40 or 30% v/v. Most preferably its concentration is from 5 to 30% v/v.

In general, the concentration d of the Fischer-Tropsch derived fuel component, in a fuel composition which results from carrying out the present invention, will be less than the concentration d' which equation (I) above would predict to be needed in order to achieve the target cetane number X. Where such a composition contains a blend of two or more fuel components, its cetane number can be predicted based on linear blending rules. For instance, if a composition contains a concentration x % v/v of a non-Fischer-Tropsch derived fuel component having a cetane number A, and (100−x) % v/v of a Fischer-Tropsch derived component having a (usually higher) cetane number B, then the cetane number CN of the blend may be calculated using equation (II) below:

$$CN=A+x(B-A)/100 \quad \text{(II)}.$$

Such calculations can be combined with equation (I) above to derive the theoretical concentration d' of the Fischer-Tropsch derived fuel component required to give a desired target cetane number.

When carrying out the method of the present invention the actual concentration of the Fischer-Tropsch derived fuel component, d, may for instance be at least 2, 5, 10, 15 or 20% lower than the theoretical value d'. In absolute terms, the actual concentration d may be 2% v/v or less, such as 5 or 10 or 15 or 20% v/v or less.

In the context of the fourth aspect of the present invention, the term "increasing" (as applied to the cetane number of the fuel composition) embraces any degree of increase. The increase may for instance be 5, 10, 20, 30 or 40% or more of the original cetane number. The increase may be as compared to the cetane number which would otherwise have been observed for the fuel composition in order to achieve the properties and performance required and/or desired of it in the context of its intended use. This may for instance be the cetane number of the fuel composition prior to the realisation that a Fischer-Tropsch derived fuel component could be used in the way provided by the present invention, and/or of an otherwise analogous fuel composition intended (e.g. marketed) for use in an analogous context, prior to adding a Fischer-Tropsch derived fuel component to it in accordance with the present invention.

In accordance with the present invention, any suitable ignition improver may be used in the fuel composition. Many such additives are known and commercially available, and may also be known (in the context of diesel fuels) as "cetane improvers" or "cetane number improvers"; they typically function by increasing the concentration of free radicals in a fuel composition. The ignition improver is preferably a diesel fuel ignition improver, i.e. an ignition improving agent suitable for use in a diesel fuel composition.

An ignition improver may for example be selected from:

a) organic nitrates of the general formula $R^1$—O—$NO_2$, or nitrites of the general formula $R^1$—O—NO, where $R^1$ is a hydrocarbyl group such as in particular an alkyl, cycloalkyl, alkenyl or aromatic group, or an ether containing group, preferably having from 1 to 10, more preferably from 1 to 8 or from 1 to 6 or from 1 to 4, carbon atoms;
b) organic peroxides and hydroperoxides, of the general formula $R^2$—O—O—$R^3$, where $R^2$ and $R^3$ are each independently either hydrogen or a hydrocarbyl group such as in particular an alkyl, cycloalkyl, alkenyl or aromatic group, preferably having from 1 to 10, more preferably from 1 to 8 or from 1 to 6 or from 1 to 4, carbon atoms (provided that $R^2$ and $R^3$ are not both hydrogen); and
c) organic peracids and peresters, of the general formula $R^4$—C(O)—O—O—$R^5$, where $R^4$ and $R^5$ are each independently either hydrogen or a hydrocarbyl group such as in particular an alkyl, cycloalkyl, alkenyl or aromatic group, preferably having from 1 to 10, more preferably from 1 to 8 or from 1 to 6, such as from 1 to 4, carbon atoms.

Examples of ignition improvers of type (a) include (cyclo)alkyl nitrates such as isopropyl nitrate, 2-ethylhexyl nitrate (2-EHN) and cyclohexyl nitrate, and ethyl nitrates such as methoxyethyl nitrate. Examples of type (b) include di-tert-butyl peroxide.

Other diesel fuel ignition improvers are disclosed in U.S. Pat. No. 4,208,190 at column 2, line 27 to column 3, line 21.

In accordance with the present invention, the ignition improver is preferably selected from (cyclo)alkyl nitrates such as 2-ethylhexyl nitrate (2-EHN), dialkyl peroxides such as di-tert-butyl peroxide, and mixtures thereof. Most preferably it is a (cyclo)alkyl nitrate such as 2-EHN.

Diesel fuel ignition improvers are commercially available for instance as HITEC™ 4103 (ex. Afton Chemical) and as CI-0801 and CI-0806 (ex. Innospec Inc.).

A fuel composition prepared according to the present invention may contain a mixture of two or more ignition improvers, for instance selected from those listed above.

In a fuel composition prepared according to the present invention, the ignition improver may be present at a concentration of up to 0.5% v/v, preferably up to 0.4 or 0.3% v/v or up to 0.25 or 0.2% v/v. Its concentration may be 0.005% v/v or more, preferably 0.01% v/v or more, more preferably 0.03 or 0.05 or 0.1% v/v or more, most preferably 0.15 or 0.2% v/v or more. Suitable concentration ranges may be from 0.05 to 0.2% v/v, more preferably from 0.1 to 0.15% v/v.

When carrying out the method of the present invention the actual concentration of the ignition improver, c, is preferably at least 50% lower than the theoretical value c', more preferably at least 60 or 70% lower, most preferably at least 70 or 75 or 80% lower than c'. The concentration c is preferably at least 0.03% v/v lower than c', more preferably at least 0.05 or 0.07% v/v lower, most preferably at least 0.1 or 0.15 or 0.2% v/v lower. In absolute terms, the concentration c may for example be 0.1% v/v or lower, preferably 0.08% v/v or lower, more preferably 0.05 or even 0.03 or 0.02% v/v or lower.

In the context of the second aspect of the present invention, the term "reducing" (as applied to the concentration of the ignition improver) embraces any degree of reduction, although preferably not reduction to zero. The reduction may for instance be of a degree as defined in the preceding paragraph. The reduction may be as compared to the concentration of ignition improver which would otherwise have been incorporated into the fuel composition in order to achieve the properties and performance required and/or desired of it in the context of its intended use, for example a desired target cetane number X. This may for instance be the concentration of ignition improver which was present in the fuel composition prior to the realisation that a Fischer-Tropsch derived fuel component could be used in the way provided by the present invention, and/or which was present in an otherwise analogous fuel composition intended (e.g. marketed) for use in an analogous context, prior to adding a Fischer-Tropsch derived fuel component to it in accordance with the present invention.

The ability to reduce the level of an ignition improver, such as 2-EHN, in a fuel composition can bring advantages not only in terms of the cost of additive incorporation but also in terms of thermal stability and health and safety compliance, as described above. Moreover, certain fuel specifications now limit the nitrogen content of for instance diesel fuels, again making it desirable to reduce levels of nitrogen-containing additives such as 2-EHN.

According to the present invention, the fuel composition may contain other additives in addition to the ignition improver and the Fischer-Tropsch derived fuel component. Many such additives are known and readily available.

The total additive content in the fuel composition may suitably be from 50 to 10000 mg/kg, preferably below 5000 mg/kg.

Any of the methods of the present invention may form part of a process for, or be implemented using a system for, controlling the blending of a fuel composition, for example in a refinery. Such a system will typically include means for introducing a Fischer-Tropsch derived fuel component and an ignition improver into a blending chamber, optionally together with a non-Fischer-Tropsch derived base fuel; flow control means for independently controlling the flow rates and/or durations of the constituents into the chamber; means for calculating the concentration of the ignition improver and/or the Fischer-Tropsch derived fuel component needed to achieve a desired target cetane number X input by a user into the system; and means for directing the result of that calculation to the flow control means which is then operable to achieve the desired concentrations of the ignition improver and/or the Fischer-Tropsch derived fuel component in the product composition, by altering the flow rates and/or flow durations of its constituents into the blending chamber.

In order to calculate the required concentration(s), a process or system of this type will suitably make use of known cetane numbers for the fuel component(s) concerned, and conveniently also a model predicting the cetane number of mixtures of these component(s) with varying concentrations of the ignition improver, according to theoretical predictions such as equation (I) above. The process or system may then, according to the present invention, select and produce an ignition improver concentration, and/or a Fischer-Tropsch derived fuel concentration, lower than that predicted by the theoretical model to be necessary. It may use a so-called quality estimator which will provide, using a model, a real-time prediction of the cetane number of each resulting blend from available raw process measurements, such as for example the NIR measured cetane numbers and the flow rates of the constituents. More preferably such a quality estimator is calibrated on-line by making use of for example the method described in WO-A-02/06905.

The method of the present invention may thus conveniently be used to automate, at least partially, the formulation of a fuel composition, preferably providing real-time control over the relative proportions of the ignition improver and the Fischer-Tropsch derived fuel component incorporated into the composition, for instance by controlling the relative flow rates and/or flow durations of the constituents.

The present invention may be used to achieve extremely high cetane numbers in fuel compositions, taking advantage of the synergistic cetane boosting effects of an ignition improver and a Fischer-Tropsch derived fuel component. Using for example a blend of a Fischer-Tropsch derived gas oil with a petroleum-derived diesel base fuel, and a standard concentration of an ignition improver such as 2-EHN, cetane numbers in excess of 70 or even 80 can readily be achieved. Such cetane numbers may not have been achieved in the past, in particular in diesel fuels, and/or may not have been thought commercially feasible using available fuel components and additives.

Thus according to a seventh aspect of the present invention, there is provided a fuel composition having a cetane number (typically a derived cetane number, IP 498) of 85 or greater, preferably 90 or 95 or greater, more preferably 100 or 105 or even 110 or 120 or greater. Such a composition suitably has been prepared, and/or is preparable, using a method according to any one of the first to the sixth aspects of the present invention. Thus the cetane number of the composition will have been achieved by incorporation into the fuel composition of (i) a Fischer-Tropsch derived fuel component and (ii) an ignition improver.

The fuel composition of the seventh aspect of the present invention is preferably a diesel or kerosene fuel composition, more preferably a diesel fuel composition, such as an automotive diesel fuel. It may in general terms be a fuel composition which is intended and/or adapted and/or suitable for use in a compression ignition engine.

An eighth aspect of the present invention provides a fuel composition having a cetane number (typically a derived cetane number, IP 498) of 70 or greater, preferably of 75 or 80 or greater, which composition contains 50% v/v or less of Fischer-Tropsch derived fuel components.

The present invention may also provide a fuel composition having a cetane number (typically a derived cetane number, IP 498) of 60 or greater, preferably of 65 or 70 or greater, which composition contains 30% v/v or less of Fischer-Tropsch derived fuel components.

The ability to achieve such high cetane numbers in for instance diesel fuel compositions may ultimately allow greater flexibility in the design and/or operation of fuel-consuming systems, such as diesel engines, intended to be run on the fuel compositions. An automotive diesel engine may for example be operated at a lower compression ratio if it can be supplied with a much higher cetane number fuel, which in turn can give the advantage of reduced frictional loss.

A ninth aspect of the present invention provides a method of operating a fuel consuming system, which method involves introducing into the system a fuel composition prepared in accordance with any one of the first to the sixth aspects of the present invention, and/or a fuel composition according to the seventh or eighth aspect. The fuel composition is preferably introduced for one or more of the purposes described above in connection with the first to the sixth aspects of the present invention, in particular to improve the combustion of the composition in the system, most particularly to improve ease of fuel ignition during use of the system.

The fuel consuming system may in particular be an engine, such as an automotive or aeroplane engine, in which case the method may involve introducing the fuel composition into a combustion chamber of the engine. It may be an internal combustion engine, and/or a vehicle which is driven by an internal combustion engine. The engine is preferably a compression ignition (diesel) engine. Such a diesel engine may be of the direct injection type, for example of the rotary pump, in-line pump, unit pump, electronic unit injector or common rail type, or of the indirect injection type. It may be a heavy or a light duty diesel engine.

Throughout the description and claims of this specification, the words "comprise" and "contain" and variations of the words, for example "comprising" and "comprises", mean "including but not limited to", and do not exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Preferred features of each aspect of the present invention may be as described in connection with any of the other aspects.

Other features of the present invention will become apparent from the following examples. Generally speaking the present invention extends to any novel one, or any novel combination, of the features disclosed in this specification (including any accompanying claims and drawings). Thus features, integers, characteristics, compounds, chemical moieties or groups described in conjunction with a particular aspect, embodiment or example of the present invention are to be understood to be applicable to any other aspect, embodiment or example described herein unless incompatible therewith.

Moreover, unless stated otherwise, any feature disclosed herein may be replaced by an alternative feature serving the same or a similar purpose.

The following example illustrates the properties of fuel compositions prepared in accordance with the present invention, and assesses the effects of a Fischer-Tropsch derived gas oil and an ignition improver on the cetane numbers of diesel fuel compositions.

Fuel compositions F1 to F3, described below, were blended with varying proportions of the ignition improver 2-ethylhexyl nitrate (2-EHN) (ex. Afton Chemical).

F1 a commercially available ultra low sulphur automotive diesel fuel (petroleum derived), sourced in the UK.

F2 a Fischer-Tropsch derived gas oil (ex. Shell).

F3 a blend containing 50% v/v of F1 and 50% v/v of F2.

The three fuel compositions had the properties listed in Table 1 below.

TABLE 1

| Fuel property | Test method | F1 | F2 | F3 |
|---|---|---|---|---|
| Derived cetane number (IQT) | IP 498 | 53.0 | 82.2 | 66.5 |
| Density @ 15° C. g/cm$^3$) | IP 365/ASTM D4052 | 0.834 | 0.7850 | 0.8087 |
| Kinematic viscosity @ 40° C. centistokes | IP 71/ASTM D445 | 2.685 | 3.606 | |
| Cloud point (° C.) | IP 219 | −9 | +2 | |
| CFPP (° C.) | IP 309 | −10, −11 | 0 | |
| Distillation (° C.): | IP 123/ASTM D86 | | | |
| IBP | | 160.8 | 211.5 | |
| 10% recovered | | 201.5 | 249.0 | |
| 20% | | 226.0 | 262.0 | |
| 30% | | 248.1 | 274.0 | |
| 40% | | 264.7 | 286.0 | |
| 50% | | 277.0 | 298.0 | |
| 60% | | 287.6 | 307.5 | |
| 70% | | 298.0 | 317.0 | |
| 80% | | 309.8 | 326.5 | |
| 90% | | 325.3 | 339.0 | |
| 95% | | 339.3 | 349.0 | |
| FBP | | 351.8 | 354.5 | |
| Sulphur content (WDXRF) (mg/kg) | ASTM D2622 | 35 | <5 | |
| Aromatics (% m) | IP 391 (mod) | | | |
| Mono | | 22.8 | <0.1 | |
| Di | | 2.4 | 0 | |
| Tri | | 0.3 | 0 | |
| Total | | 25.5 | <0.1 | |

The derived cetane numbers of blends containing fuels F1 to F3 and 2-EHN were determined using the Ignition Quality Tester (IQT), according to the standard test method IP 498.

The predicted cetane number of each blend was also calculated using equation (I) above (SAE paper number 972901). Both derived and predicted cetane numbers are shown in Table 2 below. Table 2 also indicates both the predicted and actual cetane "boost" in each case, i.e. the increase in cetane number due to incorporation of the relevant concentration of the ignition improver.

TABLE 2

| Fuel composition | 2-EHN (% v/v) | Predicted cetane number | Derived cetane number | Predicted cetane boost | Actual cetane boost |
|---|---|---|---|---|---|
| F1 | 0 | 53 | 53 | 0 | 0 |
| F1 | 0.05 | 56.3 | 58.4 | 3.3 | 5.4 |
| F1 | 0.1 | 58.4 | 61.4 | 5.4 | 8.4 |
| F1 | 0.3 | 63.2 | 66.3 | 10.2 | 13.3 |
| F2 | 0 | 82.2 | 82.2 | 0 | 0 |
| F2 | 0.05 | 86.7 | 101.7 | 4.5 | 19.5 |
| F2 | 0.1 | 89.6 | 107.1 | 7.4 | 24.9 |
| F2 | 0.3 | 96.0 | 121.9 | 13.8 | 39.7 |
| F3 | 0 | 66.5 | 66.5 | 0 | 0 |
| F3 | 0.05 | 70.4 | 76.1 | 3.9 | 9.6 |
| F3 | 0.1 | 72.9 | 80 | 6.4 | 13.5 |
| F3 | 0.3 | 78.4 | 88.4 | 11.9 | 21.9 |

Table 2 shows that the fuel compositions containing, or based on, the Fischer-Tropsch derived gas oil have a significantly higher cetane number, for any given concentration of the ignition improver additive, than theory predicts. This "boost" in cetane number is only observed to a much lesser extent for the conventional refinery diesel fuel F1.

Efficiency of an ignition improver is a function of the type of fuel to which it is added. In general, the higher the starting cetane number of the fuel, the more efficient an ignition improver will be in increasing its cetane number yet further, as formalised in equation (I) above. What has been discovered is the previously unknown, and unexpectedly high, boost in cetane number, as compared to the theoretical value, when both a Fischer-Tropsch derived fuel component and a standard ignition improver are present in a fuel composition.

Thus if one is aiming for a target cetane number X in the overall blend, it is possible to include a lower concentration of either the Fischer-Tropsch derived fuel or, often more advantageously, of the ignition improver, than theory would predict to be necessary. For example, in fuel F3 containing 50% v/v of a Fischer-Tropsch derived gas oil, if the target cetane number is 73, which theory would predict to be possible only using approximately 0.1% v/v of 2-EHN, then in accordance with the present invention it is possible to reduce the 2-EHN concentration to below 0.05% v/v whilst still achieving the target, with all the resultant benefits (e.g. in terms of fuel stability, safety and reduced cost) discussed above.

In situations where ignition improver levels have been predetermined, for instance due to additive introduction at the refinery, a Fischer-Tropsch derived fuel may nevertheless be used, in accordance with the present invention, to yield a higher than predicted increase in cetane number, as well as other advantages more generally associated with the use of such fuels.

The Table 2 data also show that exceptionally high cetane numbers can be achieved in diesel fuel compositions containing both an ignition improver and a Fischer-Tropsch derived fuel component, as compared to the cetane numbers achievable using only a conventional petroleum-derived diesel fuel (F1) with an ignition improver. This is likely to be of value not only in conventional diesel engines but also potentially in future engines which may be tailored to respond to higher cetane number fuels, for example engines with relatively low compression ratios (which in turn may benefit from improved fuel economy and/or increased power).

The invention claimed is:

1. A method for synergistically increasing the cetane number of a fuel composition, the method comprising:

providing an initial fuel composition exhibiting an initial cetane number, the initial fuel composition comprising 0.5% v/v. to 60% v/v. of one or more non Fischer Tropsch derived middle distillate fuel components and at least 40% v/v. Fischer-Tropsch derived fuel component; and adding to the fuel composition a concentration c of from 0.1% v/v. to 0.3% v/v. of an ignition improver to produce a fuel composition exhibiting a target cetane number that is 5% or more higher than the initial cetane number;

wherein the concentration c is at least 50% lower than a theoretical concentration c' required to achieve the target cetane number, the target cetane number is above a theoretically possible cetane number, and the target cetane number exhibits a cetane boost that is 70% or more higher than a theoretical cetane boost calculated based on the effects of the components of the fuel composition, individually;

wherein the ignition improver is selected from the group consisting of organic peracids and organic peresters of the general formula $R^4$—C(O)—O—O—$R^5$, where $R^4$ and $R^5$ are each independently selected from the group consisting of hydrogen and hydrocarbyl groups having from 1 to 10 carbon atoms selected from the group consisting of alkyl groups, cycloalkyl groups, alkenyl groups, and aromatic groups.

2. The method of claim 1 comprising up to 50% v/v. of the one or more non Fischer Tropsch derived middle distillate fuel components.

3. A fuel composition comprising:

an initial fuel composition exhibiting an initial cetane number, the initial fuel composition comprising 0.5% v/v. to 60% v/v. of one or more non Fischer Tropsch derived middle distillate fuel components and at least 40% v/v. Fischer-Tropsch derived fuel component;

a concentration c of from 0.1% v/v. to 0.3% v/v. of an ignition improver; wherein the-fuel composition exhibits a target cetane number that is 5% or more higher than the initial cetane number;

wherein the concentration c is at least 50% lower than a theoretical concentration c' required to achieve the target cetane number, the target cetane number is above a theoretically possible cetane number, and the target cetane number exhibits a cetane boost that is 70% or more higher than a theoretical cetane boost calculated based on the effects of the components of the fuel composition, individually;

wherein the ignition improver is selected from the group consisting of organic peracids and organic peresters of the general formula $R^4$—C(O)—O—O—$R^5$, where $R^4$ and $R^5$ are each independently selected from the group consisting of hydrogen and hydrocarbyl groups having from 1 to 10 carbon atoms selected from the group consisting of alkyl groups, cycloalkyl groups, alkenyl groups, and aromatic groups.

4. The fuel composition of claim 3 comprising up to 50% v/v. of the one or more non Fischer Tropsch derived fuel components.

* * * * *